US005515697A

United States Patent [19]

Chen

[11] Patent Number: 5,515,697

[45] Date of Patent: May 14, 1996

[54] RIB JACQUARD KNITTING MACHINE FOR KNITTING EYELET CONSTRUCTION AS WELL AS TRANSFER CONSTRUCTION

[75] Inventor: Wan-Yih Chen, Taipei, Taiwan

[73] Assignee: Pai Lung Machinery Mill Co., Ltd, Taipei, Taiwan

[21] Appl. No.: 318,260

[22] Filed: Oct. 5, 1994

[51] Int. Cl.[6] ..... D04B 9/22; D04B 9/26

[52] U.S. Cl. ..... 66/20; 66/24

[58] Field of Search ..... 66/19, 20, 24, 66/29

[56] References Cited

U.S. PATENT DOCUMENTS

| | | | |
|---|---|---|---|
| 2,040,319 | 5/1936 | Lombardi | 66/24 |
| 2,092,701 | 9/1937 | Ingalls | 66/24 |
| 2,181,679 | 11/1939 | McAdams | 66/24 |
| 2,397,456 | 3/1946 | Sirmay | 66/24 X |
| 2,442,442 | 6/1948 | Shortland | 66/24 |
| 2,622,421 | 12/1952 | Minton | 66/24 |
| 2,997,865 | 8/1961 | Philip | 66/24 |

FOREIGN PATENT DOCUMENTS

| | | | |
|---|---|---|---|
| 1207289 | 2/1960 | France | 66/24 X |
| 513186 | 11/1930 | Germany | 66/20 |

*Primary Examiner*—John J. Calvert
*Attorney, Agent, or Firm*—Bacon & Thomas

[57] ABSTRACT

A rib jacquard knitting machine including dial needles arranged on the dial, cylinder needles arranged on the needle cylinder to knit loops with the dial needles, transfer needles and pelerine needles respectively arranged on the needle cylinder to make transfer stitches and eyelet stitches. A knit selector selectively drives the pelerine needles and the transfer needles into operative positions.

2 Claims, 9 Drawing Sheets

RIB JACQUARD KNITTING MACHINE FOR KNITTING EYELET CONSTRUCTION AS WELL AS TRANSFER CONSTRUCTION

BACKGROUND OF THE INVENTION

The present invention relates to a jacquard knitting machine for producing ribbed fabric, and relates more particularly to such a rib jacquard knitting machine for knitting eyelet stitches as well as transfer stitches.

A rib jacquard knitting machine uses two sets of needles for knitting rib jacquard fabrics. The action of a jacquard knitting is performed by means of the operation of a needle section unit, which is disposed close to the feet of the needles or the tails of the sinkers and controlled to selectively lift the needles or push the sinkers, to make a colored, crimped, eyed, pattern work. A fabric made according to this method is called jacquard fabric. Conventionally, a rib jacquard knitting machine is made by attaching a needle selection unit to a rib knitting machine.

A jacquard fabric having an eyelet stitch or a transfer stitch is formed by means of the action of pelerine needles or transfer needles. According to conventional methods, pelerine needles and transfer needles cannot be arranged on one rib jacquard knitting machine, i.e., pelerine needles and transfer needles must be arranged on different rib jacquard knitting machines for different knitting patterns. Therefore, a rib jacquard knitting machine for knitting a transfer stitch cannot produce an eyelet stitch. On the contrary a rib jacquard knitting machine for knitting an eyelet stitch cannot product a transfer stitch.

Furthermore, a transfer needle and a pelerine needle are different in structure. If a rib jacquard knitting machine which is equipped with transfer needles is to be changed into a design having pelerine needles, the transfer needles must be completely removed from the machine for allowing pelerine needles to be installed, and the original cam section for driving the transfer needles must also be replaced by cam sections for driving pelerine needles. Therefore, it is not economic to change the design of a rib jacquard knitting machine for knitting a transfer stitch to the design for knitting an eyelet stitch or vice versa.

SUMMARY OF THE INVENTION

The present invention has been accomplished under the circumstances in view. It is therefore the principal object of the present invention to provide a versatile rib jacquard knitting machine which is equipped with transfer needles as well as pelerine needles for knitting a variety of rib jacquard fabrics.

It is another object of the present invention to provide a versatile rib jacquard knitting machine which is equipped with transfer needles, pelerine needles, latch needles, and a knit selector, wherein the knit selector selectively lifts the transfer needles or pelerine needles to match with the action of the latch needles so as to make rib jacquard fabrics of variable patterns.

It is still another object of the present invention to provide a versatile rib jacquard knitting machine which permits the knit selector to be changed so as to match with the selection of the aforesaid transfer needles and pelerine needles for constructing rib fabrics, rib jacquard fabrics, eyelet stitch jacquard fabrics, transfer stitch jacquard fabrics, ribbed eyelet and transfer stitch jacquard fabrics, as well as single side and double-side eyelet stitch jacquard fabrics of different specifications.

DETAILED DESCRIPTION OF THE PREFERRED EMBODIMENT

Before describing the detailed structure of the present invention, the fabric knitting process of a knitting mechanism and the fabric construction of the product made thereby must be understood.

Figure 1C:
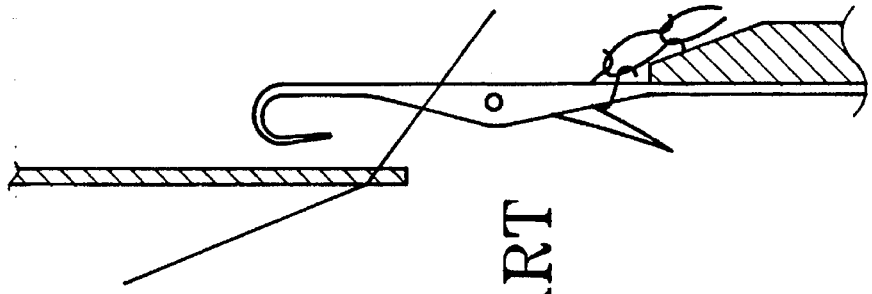
Fig.1C PRIOR ART
FIGS. 1A through 1E show the continuous action of making loops by latch needles according to the prior art.
Figure 1B:
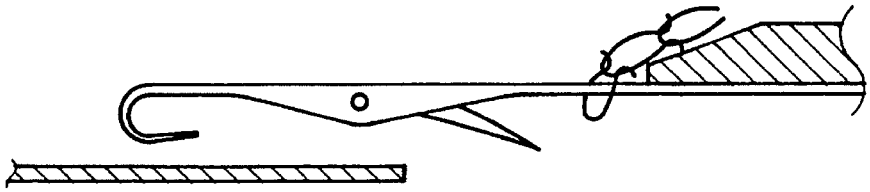
Fig.1B PRIOR ART
Figure 1A:
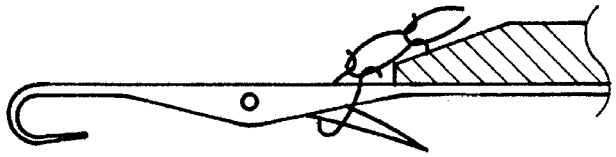
Fig.1A PRIOR ART
Figure 1E:
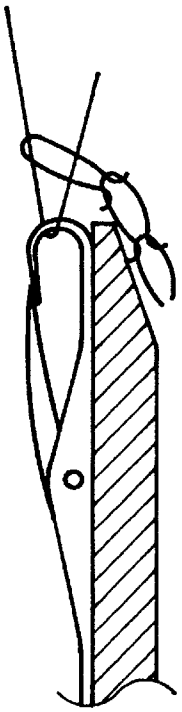
Fig.1E PRIOR ART
Figure 1D:
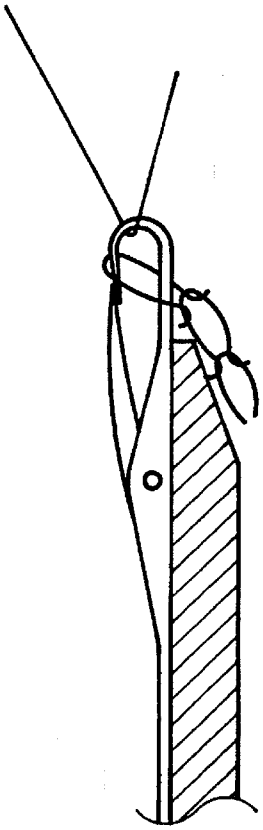
Fig.1D PRIOR ART

Referring to FIGS. 1A through 1E, latch needles are the major elements of a circular knitting machine. By means of reciprocating the latch needles of a circular knitting machine, threads are knitted into a fabric formed of continuous loops. This action is called loop formation effect and described hereinafter. When the needle is lifted, as shown in FIG. 1A, the latch of the needle is depressed and opened by the last loop when the last lop slips downwards toward the tip of the latch. When the needle reaches the upper limit, as shown in FIG. 1B, the last loop drops to the shank of the needle. When the needle moves downwards, as shown in FIG. 1C, the last loop is moved upwards along the shank of the needle, and at the same time the feed carrier guides the thread to the hook of the needle. When the needle is continuously moved downwards, as shown in FIG. 1D, the latch of the needle is closed, causing the thread to be hooked downwards by the hook of the needle. When the needle reaches the lower limit, as shown in FIG. 1E, the last loop escapes from the needle and forms part of the fabric, and at the same time, a new loop is formed. The fabric is made by repeating the aforesaid loop forming action.

Figure 2A:
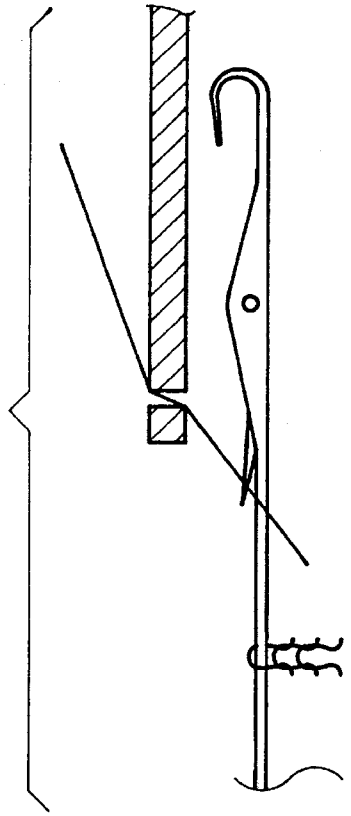
Fig.2A PRIOR ART
FIGS. 2A through 2E show different forward strokes of latch needles according to the prior art and fabric constructions made thereby.
Figure 2B:
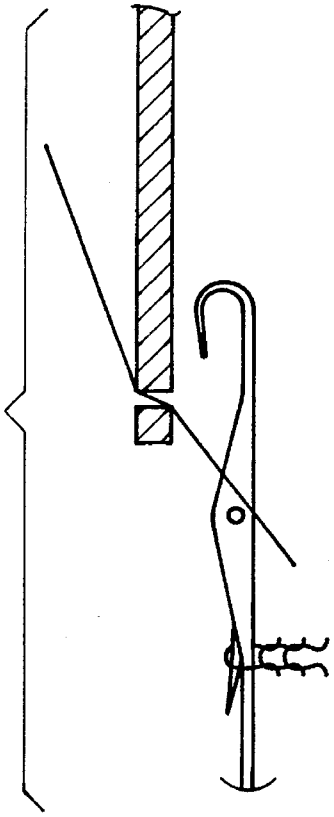
Fig.2B PRIOR ART
Figure 2C:
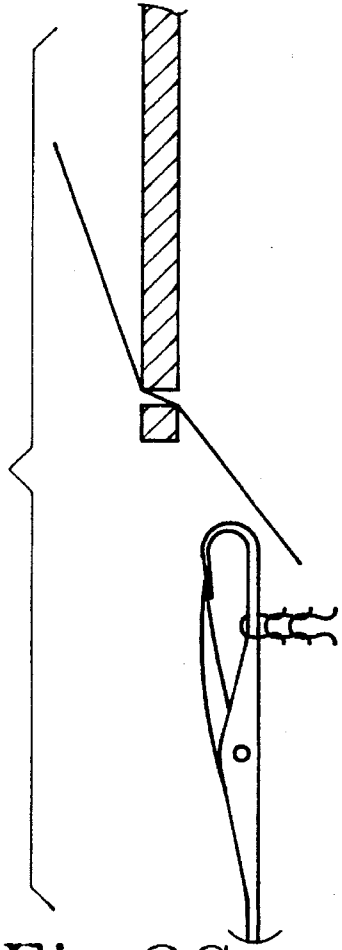
Fig.2C PRIOR ART
Figure 2E:
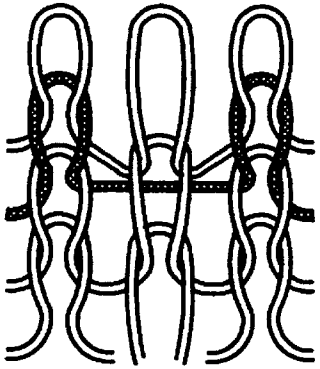
Fig.2E PRIOR ART
Figure 2D:
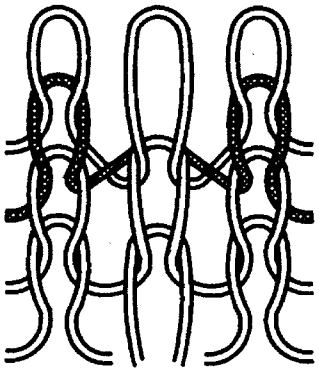
Fig.2D PRIOR ART
Figure 6B:
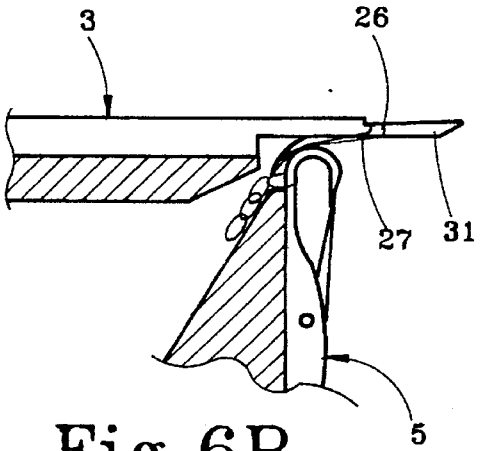
FIGS. 4A through 7 show the continuous action of making an eyelet stitch according to the present invention.
Figure 6A:
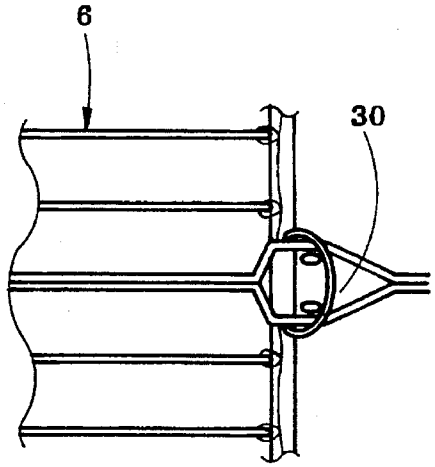

By means of controlling the order of the needles of the knitting machine, the construction of the fabric can be changed, and the therefore a convex-concave or pattern work can be achieved. The forward stroke of the needle can be controlled in three ways. According to the first manner as shown in FIG. 2A, the needle reaches the upper limit during its forward stroke, so as to further hook the thread and allow the last loop to escape during its backward stroke, and therefore interlinked loops can formed as shown in FIG. 2D. According to the second manner as shown in FIG. 2B, the needle reaches only halfway of the route to the upper limit during its forward stroke, so as to further hook the thread without letting the last loop to escape during its backward stroke, and therefore hanging loops can be formed as shown in FIG. 2D. According to the third manner (namely the idle course) as shown in FIG. 2C, the needle does no work or runs in idle, therefore the needle does not hook the thread, and an empty needle is formed as shown in FIG. 2E. Therefore, controlling the needles of the knitting machine to achieve different forward strokes can product different fabric structures. Furthermore, the loops shown in FIG. 2D include needle loops, which curve upwards, and sinker loops, which curve downwards.

Figure 3:
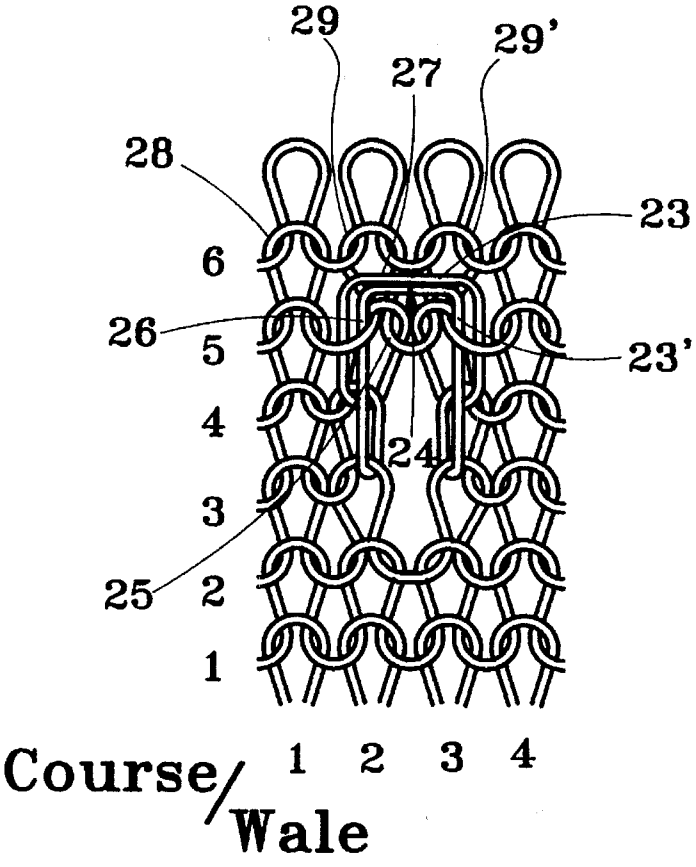
FIG. 3 illustrates an eyelet stitch according to the present invention.
Figure 8:
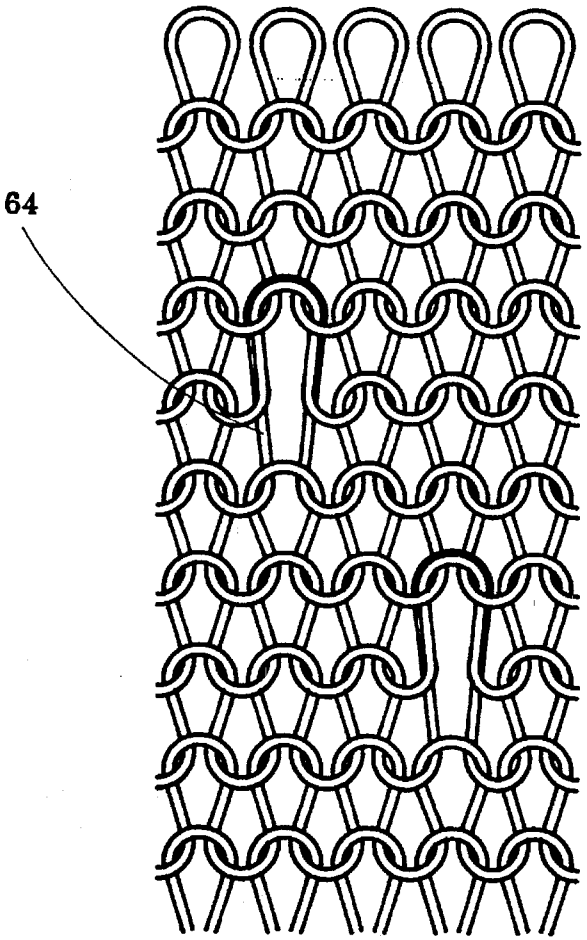
FIG. 8 illustrates a transfer stitch according to the present invention.

FIG. 3 shows an eyelet stitch made by a rib jacquard knitting machine according to the present invention. FIG. 8 illustrates a transfer stitch made by a rib jacquard knitting machine according to a rib jacquard knitting machine according to the present invention. The major difference between the eyelet stitch shown in FIG. 3 and the transfer stitch shown in FIG. 8 is the size of the loops. The loops of the transfer stitch are relatively smaller than those of the eyelet stitch. Therefore, the transfer stitch and the eyelet stitch present different patterns.

The aforesaid eyelet stitch is formed by means of the operation of a pelerine needle (see FIGS. 9A and 9B) to hang one or two sinker loops of the fabric construction onto the next or the second next thread loop so as to form an eyelet on the fabric. As shown in FIG. 3, the two sinker loops between 2 and 3 in Wale and 3 and 4 in Course have been hung on the two thread loops between 2 and 3 in Wale on 5 in Course. Therefore, an open space will be formed between 2 and 3 in Wale and 3 and 4 in Course if the construction is stretched bilaterally outwards.

Figure 7:
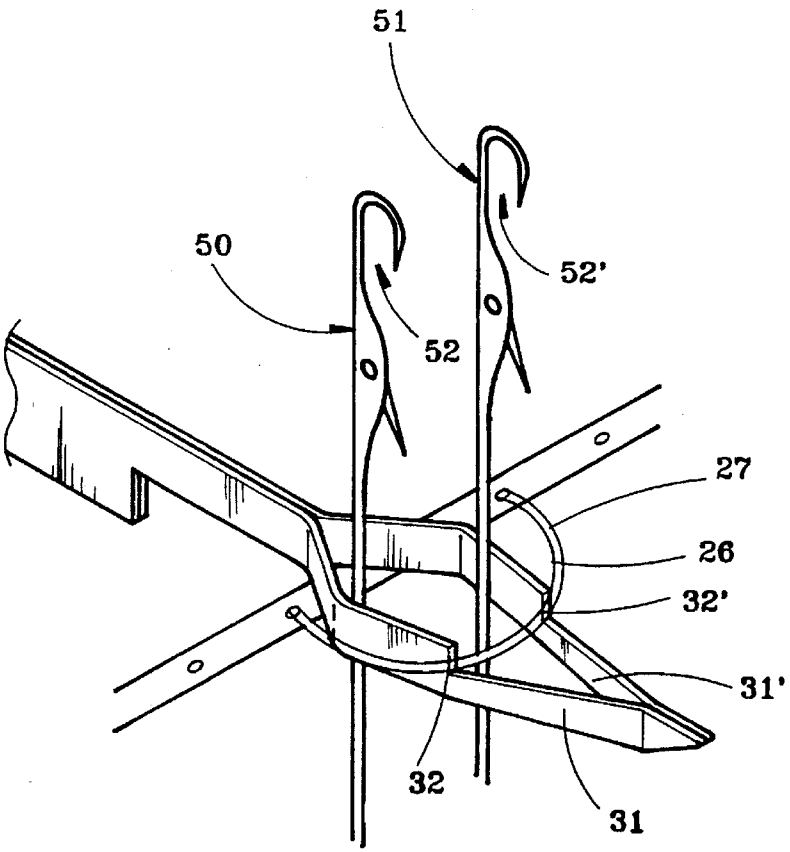
Figure 9B:
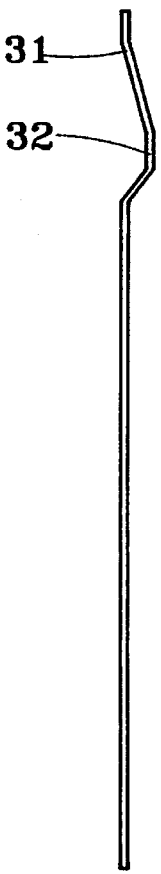
FIGS. 9A and 9B illustrate the structure of a pelerine needle according to the present invention.
Figure 9A:
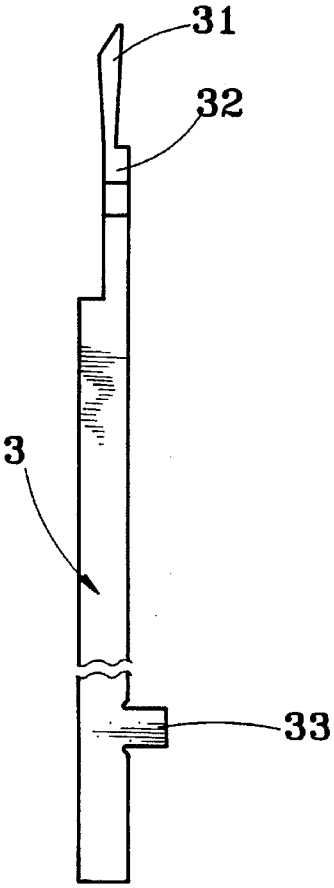

Referring to FIGS. 9A and 9B, a pelerine needle, referenced by 3, consists of two symmetrical metal plates attached together and defining an eye 30 (see also FIG. 4), each metal plate having a nose 31 or 31' and a shoulder 32 or 32' behind the nose 31 or 31' (see also FIG. 7). The noses 31 and 31' are to pick up the sinker loop 23 (see FIG. 3). The shoulders 32 and 32' are for hanging the thread loop 24 (see FIG. 3). The eye 30 is to stretch open the thread loop 24 for letting the latch needle to hook up the sinker loop 25 (see FIG. 3).

The action of the pelerine needle 3 to form an eyelet stitch is outlined hereinafter with reference to FIGS. 4A through FIG. 7.

Figure 5B:
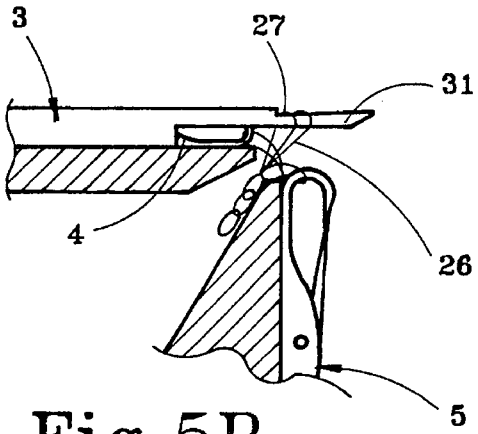
Figure 5A:
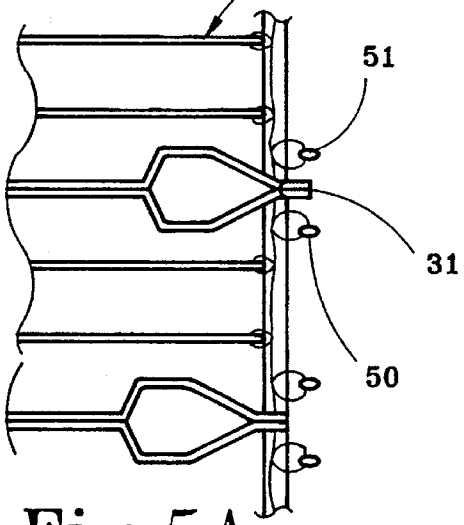
Figure 4B:
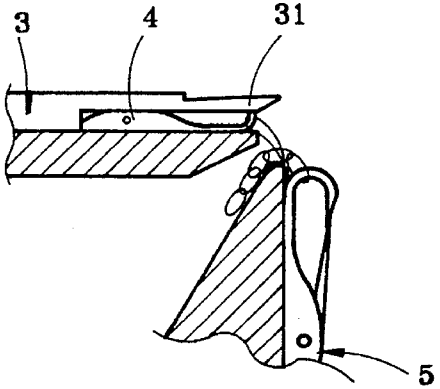
Figure 4A:
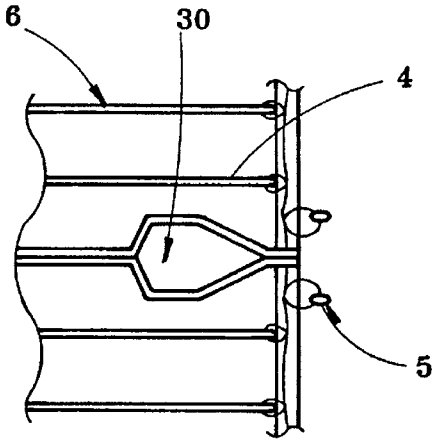

1. When the pelerine needle 3 is stopped as shown in FIGS. 4A and 4B, a thread eye guides the thread to the position between the dial needle 4 and the cylinder needle 5 to form a normal knit segment.
2. When the pelerine needle 3 is moved to the effective position (about the loop hanging position) as shown in FIGS. 5A and 5B, thread eyes continuously carry the threads 26 and 27 (see also FIG. 3) to the position between the dial needle 4 and the cylinder needle 5 and wound round the noses 31 and 31' of the pelerine needle 3. When the cylinder needles 50 and 51 are moved back to cast off loops, the sinker loops 23 become hung on the noses 31 and 31' and are caught by the pelerine needle 3.
3. When the pelerine needle 3 reaches the front limit of its forward stroke after the catch of the sinker loops 23, the sinker loops 23 are stretched open and hung on the shoulders 32 and 32'.
4. When the cylinder needles 50 and 51 reach the upper limit position as shown in FIG. 7, they pass through the eye 30 and the sinker loops 23, causing the previously formed loops and the newly formed sinker loops 23 to drop to the shanks of the cylinder needles 50 and 51.

When a thread eye carries the thread 28 to the hooks 52 and 52' of the cylinder needles 50 and 51', the pelerine needle 3 and the cylinder needles 50 and 51 are respectively moved back to their former positions. During the return stroke of the pelerine needle 3, the noses 31 and 31' are pushed apart by the cylinder needles 50 and 51, causing the two sinker loops 23 and 23' to be caught by the cylinder needles 50 and 51. When the cylinder needles 50 and 51 reach a certain elevation during their return strokes, the sinker loops 23 and 23' and the previously formed loops 29 and 20' are moved out of the cylinder needles 50 and 51 and are formed into an eyelet stitch. Because the pelerine needle 3 is formed of two symmetrical metal plates, the size of the eyelet thus formed is about equal to the pitch between the two cylinder needles 50 and 51. If the pelerine needle 3 is made of a single metal plate having a nose 31 and a shoulder 32 and defining an eye 30 for passing a single cylinder needle 50 or 51, the size of the eyelet thus formed will be relatively smaller. As the rib jacquard knitting machine is capable of making a double knitting, eyelet stitches of different specifications can be formed on one side or both sides of the rib jacquard fabrics.

Figure 10B:
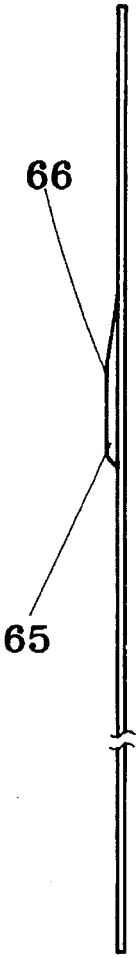
FIGS. 10A and 10B illustrate the structure of a transfer needle according to the present invention.
Figure 10A:
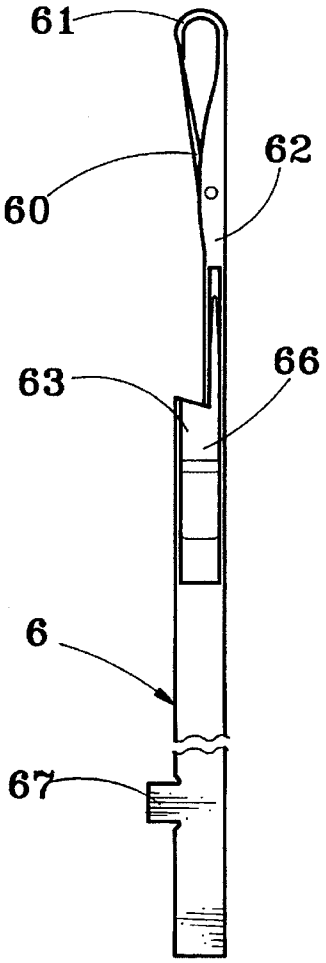
Figure 11B:
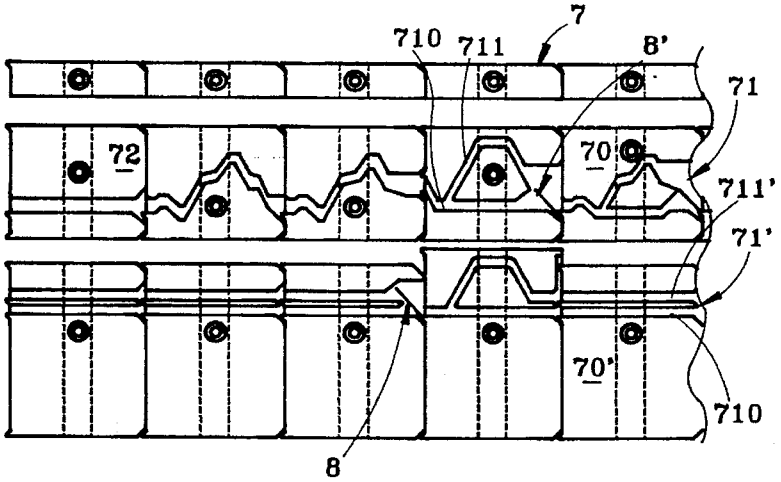
FIGS. 11A through 11C are structural drawings of a rib jacquard knitting machine according to the present invention, showing the arrangement of the needle cylinder and the knit selector.
Figure 11A:
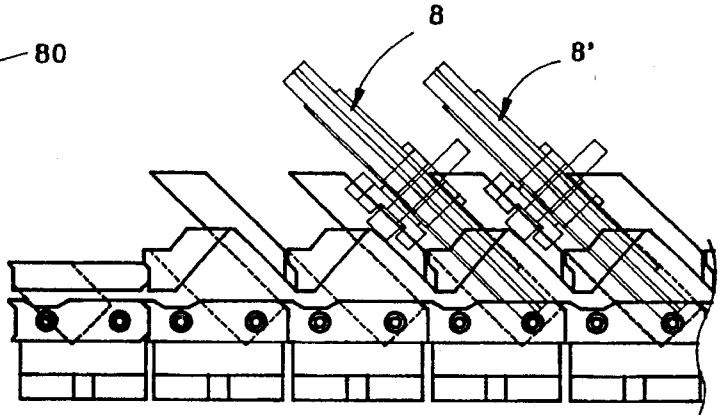
Figure 11C:
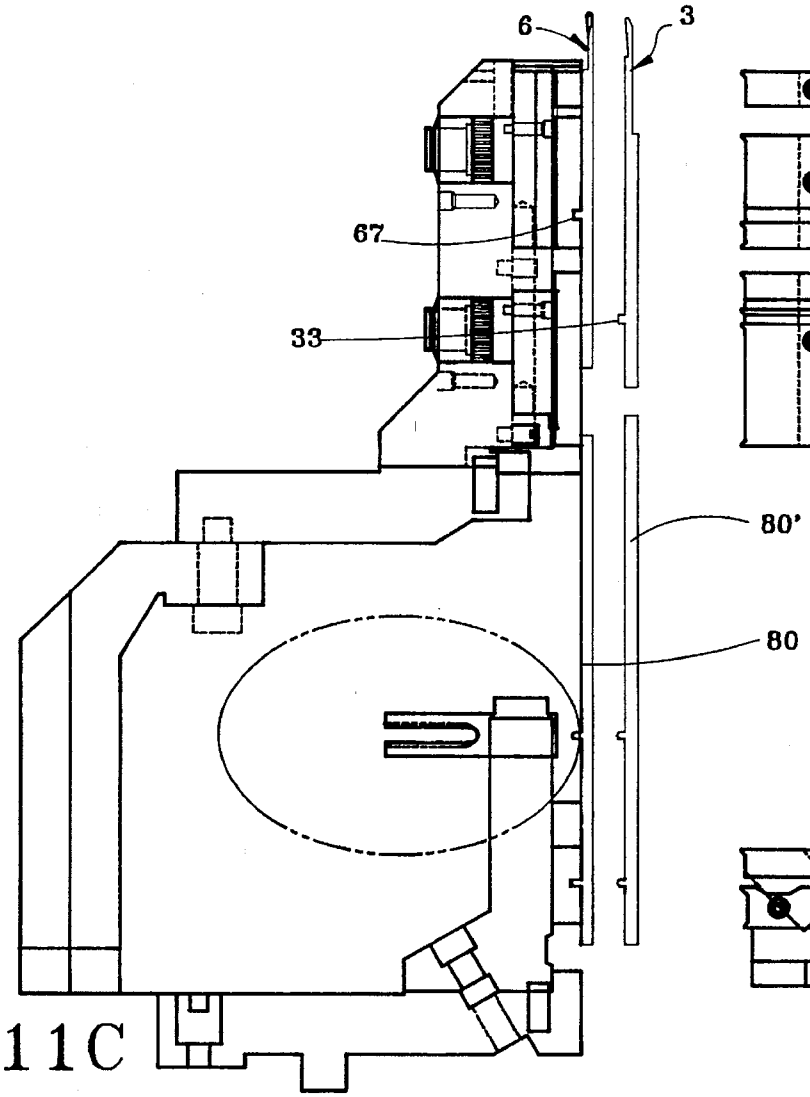
Figure 12:
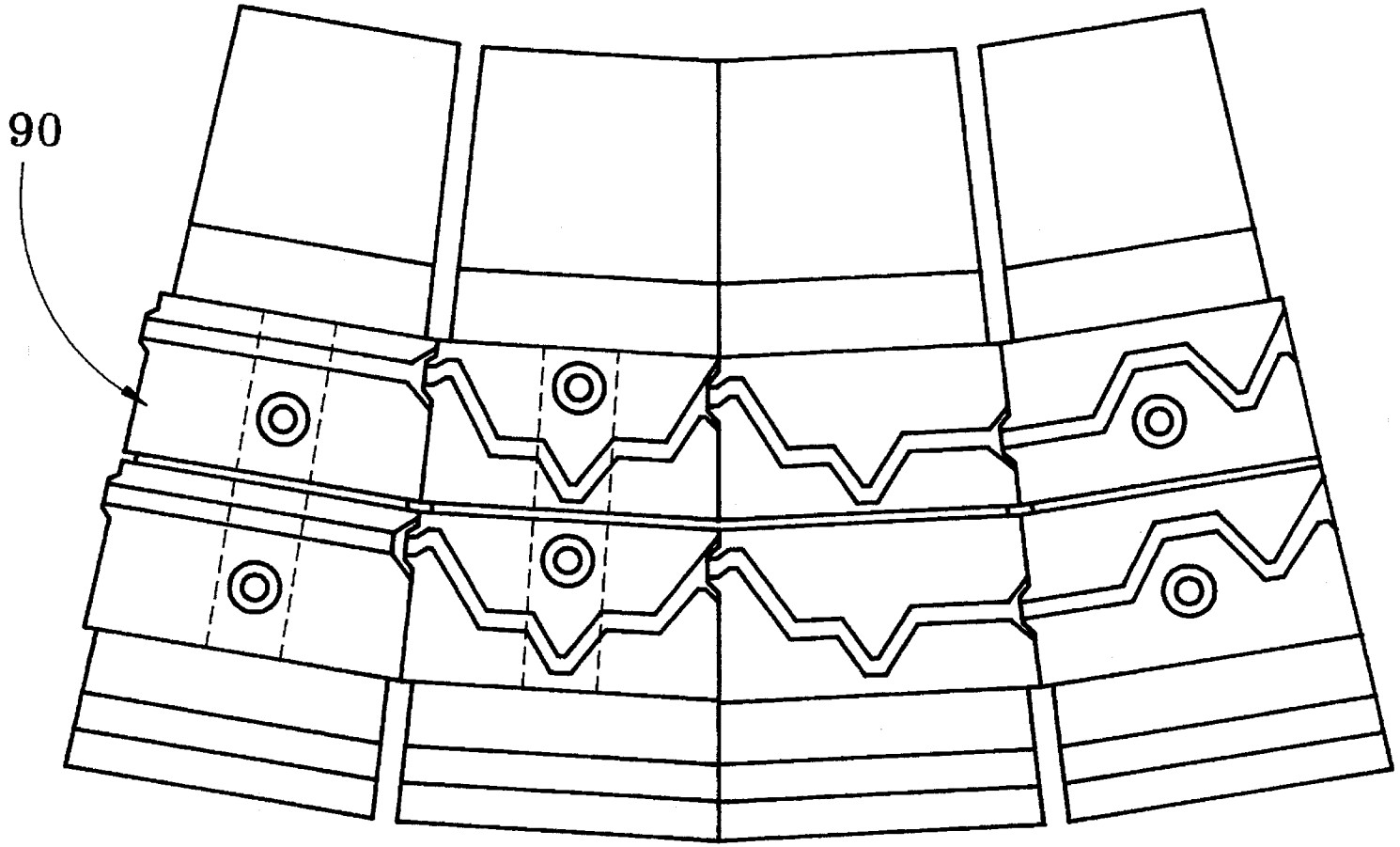
FIG. 12 shows the structure of needle cam according to the present invention.

The transfer stitch knitting action of the transfer needle 6 (see FIGS. 10A and 10B) is similar to the knitting action of the pelerine needle 3. The transfer needle 6 comprises a shank 62, a shoulder 63 at an opposite end of the shank 62 for hanging the stretched thread loop 64 (see FIG. 8), and a stretcher 66 disposed adjacent to the shoulder 63 and defining a hole 65 with the shank 62. The stretcher 66 is to stretch the thread loop 64. Unlike the aforesaid pelerine needle 3, the stretcher 66 can only stretch open one single loop and allows only one cylinder needle to pass through the hole 65. Therefore, the size of the transfer stitch made by the transfer needle 6 is relatively smaller than that of an eyelet stitch made by the pelerine.

Referring to FIGS. 11A, 11B, 11C, and 12, pelerine needles 3 and transfer needles 6 are arranged on the needle cylinder 7 of the circular jacquard knitting machine. Similar to the transfer needles 6, an individual pelerine needle 3 either of single plate or double-plate type is received in a single needle slot. The pelerine needles 3 and the transfer needles 6 may be alternatively arranged within the needle slots in the needle cylinder or arranged in any of a variety of combinations subject to the patterns designed.

The pelerine needles 3 and the transfer needles 6 are respectively reciprocated by two parallel cam sections 70 and 70', which are mounted within the needle cylinder 7 at the bottom. Because the knitting cycles of the pelerine needles 3 and the transfer needles 6 are different, the tracks 71 and 71' on the cam sections 70 and 71' are different. The tracks 71 and 71' include upper tracks 711 and 711' and lower tracks 710 and 710'. the lower tracks 710 and 710' are for normal knitting. If the pelerine needles 3 and the transfer needles 6 are driven by the lower tracks 710 and 710', they do not perform the knitting of eyelet stitch or transfer stitch. On the contrary, when the pelerine needles 3 and the transfer needles 6 are driven by the upper tracks 711 and 711', they are forced to knit an eyelet stitch or a transfer stitch. After each eyelet stitch or transfer stitch knitting process, the pelerine needles 3 and the transfer needles 6 are moved from the intersected points between the upper tracks 711 and 711' and the lower tracks 710 and 710' to the lower tracks 710 and 710' by means of the guiding of the projecting portions 33 and 67 on the pelerine needles 3 and the transfer needles 6.

The movement of the pelerine needles 3 and the transfer needles 6 from the lower tracks 710 and 710' into the upper tracks 711 and 711' is controlled by a knit selector. The knit selector comprises tilt wheels 8 and 8', and push rods 80 and 80'. The push rods 80 and 80' are normally disposed in a respective bottom position. When it is desired to knit an eyelet stitch or a transfer stitch, the push rods 80 and 80' are respectively lifted by the tilt wheels 8 and 8' to move the corresponding pelerine needles 3 or transfer needles 6 from the respective lower tracks 710 and 710' to the respective upper tracks 711 and 711', and therefore the selected pelerine needles 3 or transfer needles 6 are forced by the cam sections 70 and 70' to knit an eyelet stitch or a transfer stitch during the rotation of the needle cylinder 7.

As previously stated, a rib jacquard knitting machine includes two sets of latch needles. One set of the latch needles are vertically arranged on the needle cylinder 7 and are called cylinder needles. The other set of the latch needles are horizontally arranged on the dial and called dial needles. By means of the normal knitting action of the cylinder needles and the dial needles, a plain rib fabric is achieved. In addition to the cam sections 70 and 70' for driving the pelerine needles 3 and the transfer needles 6, a rib jacquard knitting machine of the present invention further comprises a cam section 72 for driving the cylinder needles and the dial needles. Therefore, the needle cylinder 7 of a rib jacquard knitting machine according to the present invention can be simultaneously equipped with pelerine needles 3, transfer needles 6, and cylinder needles as well as the corresponding cam sections 70, 70' and 72. A corresponding cam section 90 is installed in the dial to actuate the dial needles (see FIG. 12).

While only one embodiment of the present invention has been shown and described, it will be understood that various modifications and changes could be made without departing from the spirit and scope of the invention. For example, the pelerine needles 3 may be arranged on the needle cylinder 7 instead of the dial installation example shown in FIGS. 4A through 7.

I claim:

1. A rib jacquard knitting machine comprising:

a plurality of dial needles arranged on a dial so as to be reciprocated in a generally horizontal direction;

a plurality of cylinder needles arranged on a needle cylinder so as to be reciprocated in a generally vertical direction to knit fabrics in cooperation with said dial needles;

a plurality of transfer needles arranged on said needle cylinder;

a plurality of pelerine needles arranged on said needle cylinder;

the cylinder, transfer and pelerine needles arranged about the cylinder so as to provide a pattern which includes eyelet and transfer stitches;

two parallel sets of cam sections arranged around said needle cylinder below said pelerine needles each having upper and lower cam tracks having intersecting portions; the plurality of transfer needles engaged with the cam tracks of a first cam section and the plurality of pelerine needles engaged with the cam tracks of a second cam section whereby the transfer needles and pelerine needles engage the respective lower cam tracks in an idle position and the upper tracks in knitting positions wherein, in cooperation with the dial and cylinder needles, the transfer needles form a transfer stitch and the pelerine needles form an eyelet stitch and, a knit selector arranged on said needle cylinder near a bottom end thereof and comprising:

i) a plurality of push rods, each associated with one of the transfer and pelerine needles; and, ii) a plurality of tilt wheels acting on the plurality of push rods such that, when the tilt wheels are rotated, the associated push rods act on one of the transfer and pelerine needles to cause the needle to engage one of the upper and lower cam tracks.

2. The rib jacquard knitting machine of claim 1 wherein said dial needles, cylinder needles and transfer needles comprise latch needles.

* * * * *